US005551760A

United States Patent [19]

Sollami

[11] Patent Number: 5,551,760

[45] Date of Patent: Sep. 3, 1996

[54] TUNGSTEN CARBIDE INSERT FOR A CUTTING TOOL

[75] Inventor: Phillip A. Sollami, Herrin, Ill.

[73] Assignee: The Sollami Company, Herrin, Ill.

[21] Appl. No.: 387,066

[22] Filed: Feb. 13, 1995

Related U.S. Application Data

[63] Continuation-in-part of Ser. No. 114,832, Sep. 2, 1993, Pat. No. 5,484,191.

[51] Int. Cl.[6] ..... E21B 10/00; E21C 35/18

[52] U.S. Cl. ..... 299/105; 299/111

[58] Field of Search ..... 175/427, 426; 299/86, 79, 81, 91, 105, 111

[56] References Cited

U.S. PATENT DOCUMENTS

| | | | |
|---|---|---|---|
| 3,361,481 | 1/1968 | Maddock | 299/86 |
| 3,389,761 | 6/1968 | Ott | 175/426 |
| 3,476,438 | 11/1969 | Bower, Jr. | 299/86 |
| 3,746,396 | 7/1973 | Radd | 299/10 |
| 3,833,264 | 9/1974 | Elders | 299/86 |
| 4,065,185 | 12/1977 | Elders | 299/86 |
| 4,453,775 | 6/1984 | Clemmow | 299/81 |
| 4,664,450 | 5/1987 | Radford | 299/81 |
| 4,944,559 | 7/1990 | Sionnet et al. | 299/86 |
| 5,131,725 | 7/1992 | Rowlett et al. | 299/79 |
| 5,324,098 | 6/1994 | Massa et al. | 299/86 |

FOREIGN PATENT DOCUMENTS

| | | | |
|---|---|---|---|
| 2101657 | 1/1983 | United Kingdom | 299/79 |
| 2168404 | 6/1986 | United Kingdom | 299/79 |

*Primary Examiner*—Hoang C. Dang
*Attorney, Agent, or Firm*—Patnaude, Videbeck & Marsh

[57] ABSTRACT

A tungsten carbide tip for a cutting tool has a tapered body with a forward cutting end and a rearward base for mounting in a socket. The body has a plurality of grooves along the length thereof, which in one embodiment extend from the lower surface of the base to a point near the forward cutting end. In a second embodiment, the insert has a cylindrical inner body with a forward cutting end, and around the perimeter of the cylindrical body is a collar. Both the body and the collar are made of tungsten carbide, and the parts are bonded together by flexible material such as brazing material. The rearward surface of the base of such inserts may also be conically shaped complementary to a conically shaped lower surface of the socket into which the insert is fitted.

12 Claims, 5 Drawing Sheets

TUNGSTEN CARBIDE INSERT FOR A CUTTING TOOL

The present application is a continuation-in-part of my prior application filed on the Sep. 2, 1993 bearing Ser. No. 114,832, now U.S. Pat. No. 5,484,191.

BACKGROUND OF THE INVENTION

The present invention relates in general to inserts for tools used in machines for breaking up surfaces such as concrete and asphalt roads, and in tools used in mining, such as for coal, trona, potash and salt, and it relates in particular to improved inserts for use in such tools.

One type of machine which is used to break up concrete and asphalt pavements and other hard surfaces utilizes a plurality of tools mounted on a cutting wheel which is forced against the surface to be broken. Each tool has an elongate steel body at the forward end of which is a tungsten carbide cutting tip. When the cutting wheel rotates, the tools are carried through a circular orbit and the tungsten carbide cutting tip penetrates the surface to be cut. When the wheel is forced against a surface, the carbide tip of each tool removes a small amount of material, thereby advancing the cut into the surface.

The bodies of the cutting tools are formed of steel and are rotatably retained on the wheel such that each cutting tool is rotatable around its longitudinal axis so as to symmetrically wear the tool, thereby extending the life of the tool and the carbide cutting tip attached thereto.

Typically, each of the steel tools has a socket at the forward end thereof into which is brazed a base on the rearward end of the tungsten carbide insert. Each of the inserts has a base portion suitable for attachment to the socket of a tool, and forwardly of the base a tapered central body with a conical or semi-spherical forward cutting end. Such inserts have an overall length of about ½ inch to 1 ½ inch and a maximum diameter from about ⅝ inch to 2 inches. Because of the large number of inserts which are used in a typical cutting or excavating machine, it is very important that each of the inserts has a long useful life and resists wear, cracking and remain securing attached within the socket of the tool.

My prior application, Ser. No. 114,832, describes an improved insert having a forwardly disposed cutting end, an elongate central body and a base, and a plurality of buttresses extending from the base to the central body. The application further describes the benefits of an insert having an axial core of a harder grade of tungsten carbide than the outer portions of the cutting tip.

SUMMARY OF THE INVENTION

Briefly, in addition to the configurations for cutting tips which are set forth in my prior application Ser. No. 114,832, I have found other configurations for cutting tips which enhance the usable life of the insert and tool, and are able to endure the shock of repeated impacts against a hard surface.

In accordance with one aspect of the invention, a unitary tungsten carbide tip insert has a generally tapered body with a principal longitudinal axis. Disposed at the forward end of the body is a cutting tip, and disposed at the rearward end thereof is a base for mounting in a socket. The body has a plurality of longitudinal grooves, each of which extends forwardly from the rear surface of the base, generally parallel to the longitudinal axis of the body, and ending near the cutting end so as to define surfaces which generally extend along the principal longitudinal axis of the tapered body. In the preferred embodiment, each of the grooves has an arcuate cross section, where the cross sections are taken perpendicular to the principal longitudinal axis of the body. The grooves in the body enhance the rotation of the tool within the machine to which it is attached. Also, the portions of the body between the grooves form buttresses which support the central column of the insert. In accordance with the present invention, the buttresses extend to the forward cutting end thereby providing support along the entire length of the column. The insert may further include a vertical post disposed rearwardly of the base and axially aligned with the conical body to improve the attachment of the insert to a socket of a tool.

When tools, as described above, are used to cut very hard surfaces, each of the tungsten carbide cutting tips removes only a small amount of the hard material, and the broken particles of hard material are forced between the grooves of the insert and along the body of the metal tool to which the insert is attached. When such an insert is attached to a metal body, broken material will move through the grooves and impact against the outer surface of the tool behind the insert. Since the metal of the tool is considerably softer than the carbide insert, the metal behind the groove of the insert will be worn away, thereby creating an extension of the grooves into the metal cutting tool. The grooves within the tool will enhance the removal of the excavated particles from the cutting surfaces and thereby reduce further wear at the forward end of the tool, which in time could result in the dislodging of the cutting tip.

In another embodiment, an insert also has a generally tapered central body with a principal longitudinal axis and a forward cutting end. Across the rearward portion of the central body is a base for attachment to the socket of a cutting tool. The base has a generally planar forward surface. The central body again has a plurality of longitudinal grooves therein which are generally parallel to the longitudinal axis of the central body and extend forwardly from the planar forward surface of the base to a location near the cutting end of the tip. Like the preceding embodiment, this embodiment will result in the excavated particles traveling between the grooves and along the cutting tool and the cuttings will wear a groove in the tool which will enhance removal of such cuttings.

In another aspect of the invention, an insert has an elongate central body of tungsten carbide having a forward cutting end and a cylindrical midsection. Disposed around a portion of the midsection of the central body is an annular collar also made of tungsten carbide, and the annular collar is bonded to the cylindrical midsection by a shock absorbing adhesive material. In the preferred embodiment, the shock absorbing adhesive is a braising material.

It has been found that where a cutting tool has been applied against very hard surfaces, such as granite, the repeated impact of the insert against the stone will in time cause fracture of the insert. Fracture occurs because the insert is brittle and inflexible along its length. I have found, however, that where the insert is constructed so as to have an inner body which is bonded by a shock absorbing material to an outer collar, the insert will have a reduced incidence of fracture when applied against very hard surfaces. The shock absorbing material extending along the length of the central body will absorb a portion of the internal stress caused by the shock as the gutting tip strikes a hard object thereby reducing the breakage of such inserts and extending the useful life thereof.

The tool which retains the insert has a cylindrical rearward end for insertion in a machine, an exterior flange forward of the cylindrical rearward end, and a socket forward of the flange. In the preferred embodiment, the flange has indentations along its rearward surface for receiving the gripping ends of a retraction device for retracting the tool from the machine. The socket of the tool also has a conical lower surface to which the insert is brazed for providing enhanced support for tangential forces applied to the insert.

GENERAL DESCRIPTION OF THE DRAWINGS

A better and more complete understanding of the present invention will be had from a reading of the following detailed description taken in conjunction with the accompanying drawings wherein.

DETAILED DESCRIPTION OF THE PREFERRED EMBODIMENT

Figure 2:
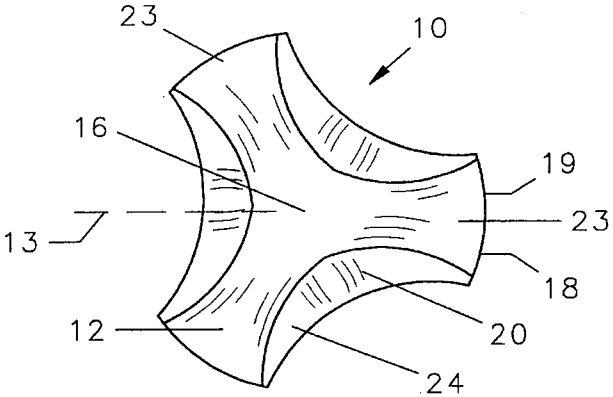
FIG. 2 is a top view of the insert shown in FIG. 1.
Figure 3:
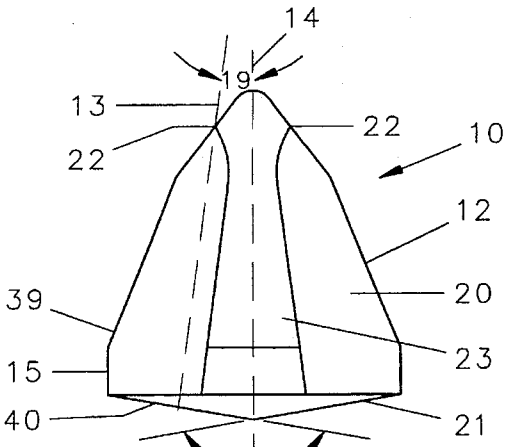
FIG. 3 is a side view of the insert shown in FIG. 1.
Figure 1:
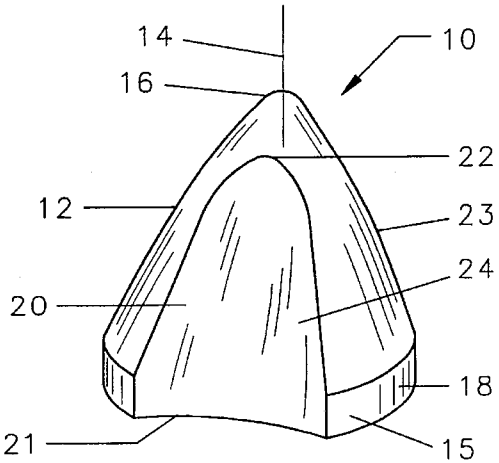
FIG. 1 is an isometric view of an insert constructed in accordance with one embodiment of the present invention.

Referring to FIGS. 1, 2 and 3, an insert 10 constructed in accordance with the present invention has a generally tapered body 12 having a principal longitudinal axis 14 around which the insert is symmetrical. At the forward end of the body 12 is a cutting end 16 and at the rearward end is a base 18 with arcuate outer sides 15 and a conical rearward surface 21 having an apex angle 17 of about 160 degrees. The base 18 is suitable for mounting the insert 10 in the socket of a tool.

The tapered body 12 has a plurality of longitudinal grooves 20 therein, each of which has a center line 13, and each of which extend from the rearward surface 21 of the base 18 forwardly, generally parallel to the axis 14 and ending a short distance from the cutting end 16 at location 22. In the preferred embodiment there re three equally spaced grooves 20, but a greater or fewer number of grooves may be provided.

It can be seen that the grooves 20 have surfaces 24 which extend along the longitudinal axis 14 of the insert, and as can be seen in FIGS. 2 and 3, the surfaces 24 slope gently inwardly toward the axis at the forward end of the insert. In the preferred embodiment, the draft angle 19 of the center line 13 to the grooves 20 is about 7 degrees. As also can be seen in FIG. 2, each of the grooves 20 has an arcuate cross sectional shape when the sections are viewed perpendicular to the axis 14 of the insert 10. As can also be seen, the portions 23 of the tapered body 12 which span between the grooves 20 provide support to the central column of the insert 10 as do the buttresses described in my copending application Ser. No. 114,832.

Figure 4:
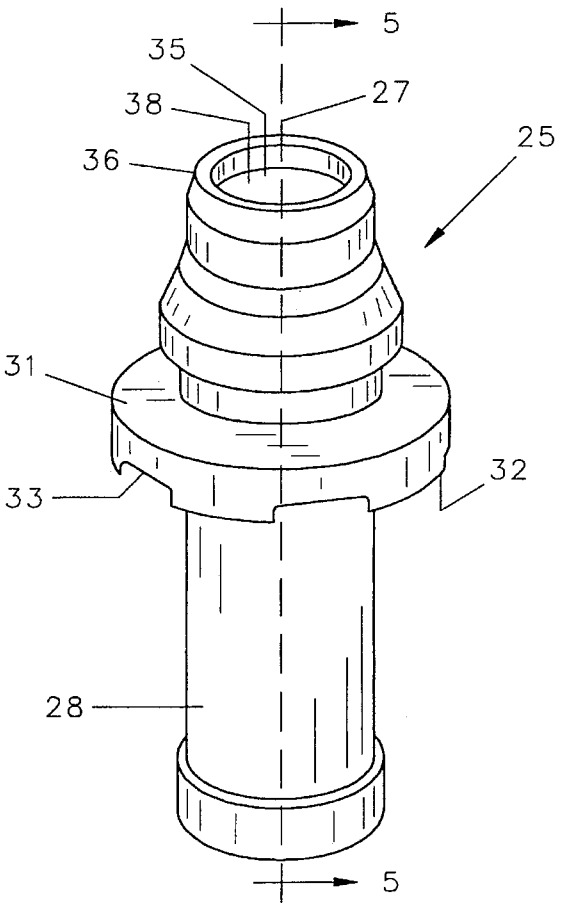
FIG. 4 is an isometric view of a tool having a socket for retaining the insert of FIG. 1.
Figure 5:
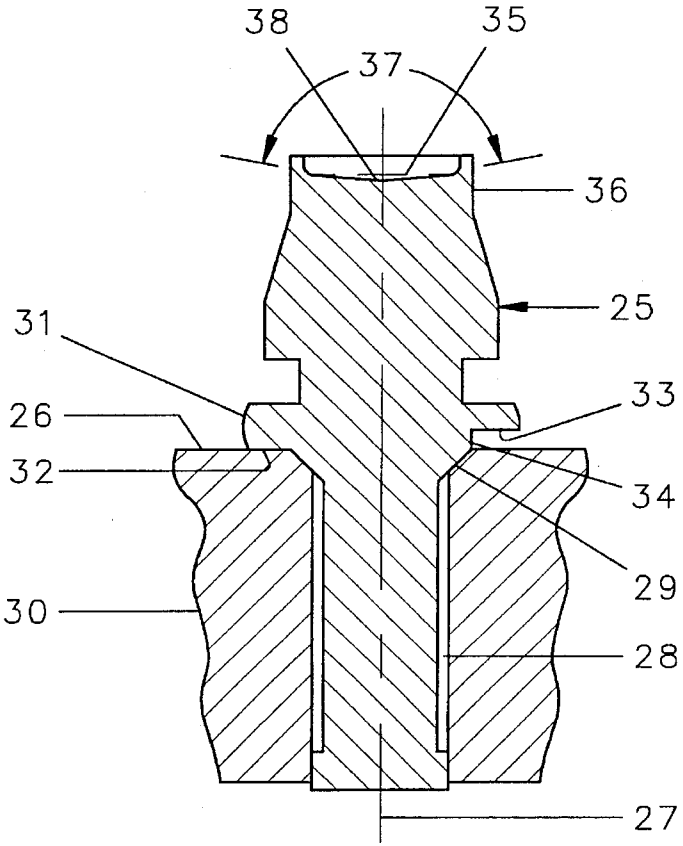
FIG. 5 is a cross-sectional view of the tool shown in FIG. 4 mounted into a machine where the cross-section of the tool is taken through line 5—5 of FIG. 4.

Referring to FIGS. 4 and 5, a tool 25 which is suitable for receiving an insert 10 has an elongate body which is symmetrical around its principal longitudinal axis 27 and at the rearward end of which is a cylindrical section 28 adapted to be pivotally retained within the machine 30 by a retainer band, not shown. Forward of the cylindrical section 28 is a frustoconical section 29 which typically tapers outward at an angle of about 45 degrees and is received in a complementary shaped recess on the machine 30. Forward of the frustoconical section 29 is an exterior flange 31 which is sometimes referred to as a "tire," and has a planar rear surface 32 .

In accordance with the present invention, spaced around the rear surface 32 of the flange 31 are a plurality of indentations 33 each of which extends to the outer diameter of the flange 31. When the tool 25 is inserted into a machine 30, the annular rear surface 32 of the flange 31 abuts against a forward surface 26 of the machine 30, however, the indentations 33 form a plurality of spaces 34 between the rear surface 32 of the flange and the forward surface 33 of the tool. The gripping ends of a retraction tool, not shown, may be inserted into the spaces 34 for grasping the flange 31 and retracting the tool 25 from the machine 30. The indentations 33 further reduce the surface area of the rear surface 32 which contacts the forward surface 26 of the machine 30 and, therefore, reduces the friction between the tool 25 and the machine 30 as the tool 25 rotates about its longitudinal axis 27. It is desirable that the tool 25 be free to rotate about its axis 27 in order that it wear symmetrically and thereby maximize its useful life.

At the forward end of the tool 25 is a recessed socket 35 having an inner shape adapted to receive the base 18 of the insert 10. In the embodiment depicted in FIG. 4, the socket 35 has a generally tubular forward end 36 with a cylindrical inner wall which is complementary to the arcuate outer sides 15 of the insert 10. In accordance with the present invention, the lower surface 38 is conical, and in the preferred embodiment, the angle 37 at the apex of the conical lower surface 38 is about 160 degrees so as to be complementary in shape to the conical rearward surface 21 of the insert 10. Where the lower surface 38 of the socket 35 and the rearward surface 21 of the insert 10 have complementary conical shapes, the insert will be self-centering within the socket. Furthermore, as can best be seen in FIG. 3, portions of the rear surface 21 of the insert 10 are substantially perpendicular to complementary portions of the outer surface of the body 12 of the insert 10. For example, the outer surface of the body 12 at point 39 is substantially perpendicular to the rearward surface of the insert at point 40. The conical configuration of the rearward surface 21, therefore, results in a more tangential loading of the brazing material which retains the rear surface 21 of the insert 10 to the lower surface 38 of the tool 25 and, therefore, offers better support for the insert within the socket 35.

Figure 6:
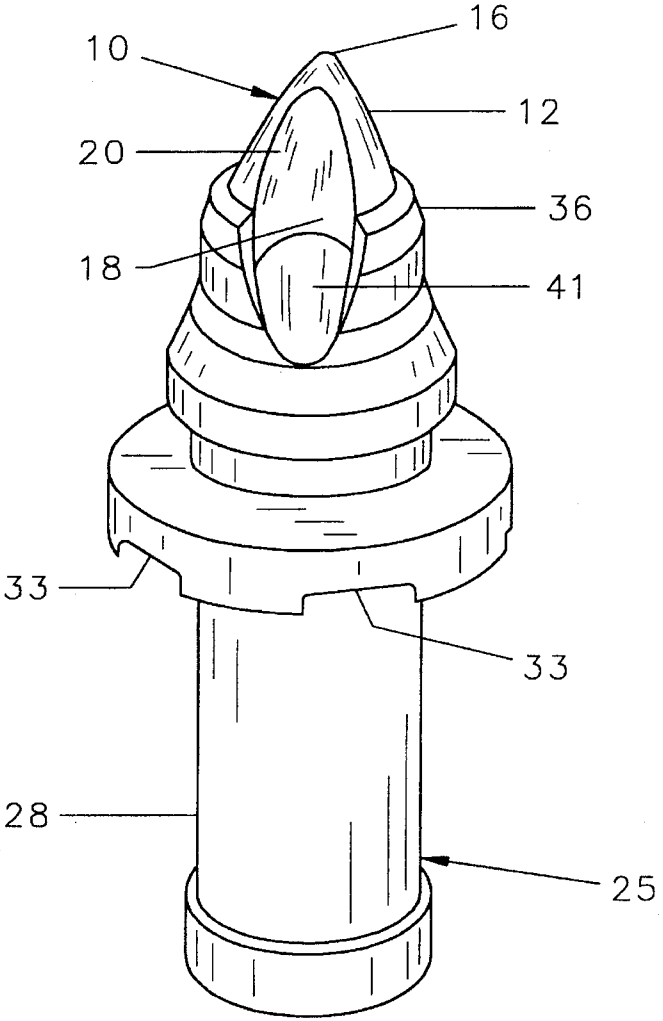
FIG. 6 is an isometric view of an insert in accordance with FIG. 1 inserted into the tool of FIG. 4, after the tool has been in use for a period of time and has had a degree of wear.

When the insert 10 is brazed into the socket 35 of the tool 25 and the tool is put into service for cutting hard substances, small particles of the cut substance will be removed by the forward end 16 and forced away from the forward end through the grooves 20. As depicted in FIG. 6, after use of the tool for a relatively short period of time, perhaps only one-tenth of the life of the tool, portions of the tubular forward end 36 of the socket which are rearward of each of the grooves 20 will become worn away. The worn portions of the tool 25 will be in the shape of grooves 41 in the forward end of the tool 25, each groove 41 is positioned immediately rearward of one groove 20 of the insert 10. The grooves 41 facilitate the direction of the particles broken up from the cutting forward end 16 away from the tool 25, and thereby reduce the wear suffered by the remaining portions of the tubular forward end 36 of the tool.

After the wearing of particles has caused grooves 41 to form at the forward end of the tool 25, further use of the tool will result in relatively few particles of hard material being channeled along the remaining portions of the tubular forward end 36 of the tool. The remaining portions of the tubular forward end will, therefore, continue to provide support to the insert 10 for retaining the insert thereon, thereby extending the useful life of the tool and the attached insert.

Although it would be desirable to manufacture a tool which has a plurality of grooves 41 positioned complementary to corresponding grooves 20 on a tip 10 inserted into the socket at the forward end thereof, such a tool would be unduly expensive to manufacture. Therefore, it is economically more feasible to construct the tool with the tubular forward end 36 as shown in FIGS. 4 and 5 and attach thereto the insert of FIGS. 1, 2 and 3 such that the grooves 41 within the tool are formed during the course of the use thereof.

Figure 7:
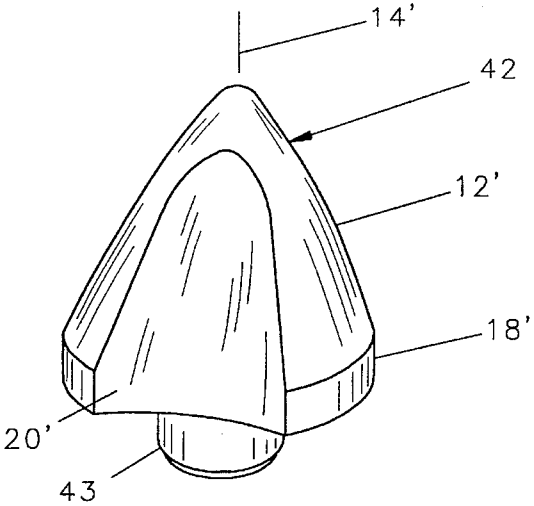
FIG. 7 is an isometric view of a modification of the insert shown in FIG. 1.
Figure 11:
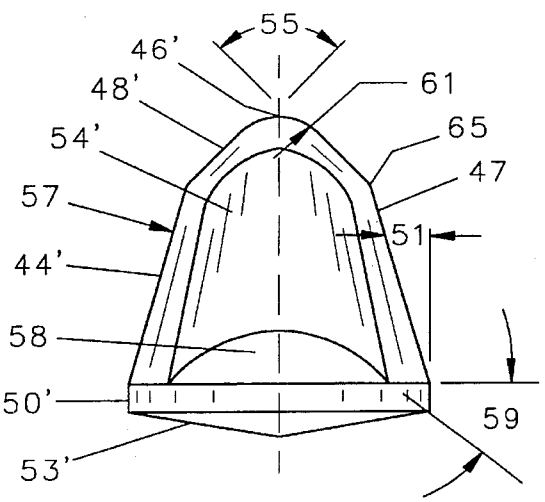
FIG. 11 is a side view of yet another insert embodying the present invention.

An alternate embodiment of the present invention is shown in FIG. 7 in which depicts an insert 42 which is similar to that depicted in FIGS. 11, 2 and 3, and in which the portions thereof which are like corresponding portions of the insert in FIGS. 1, 2 and 3 bear like indicia numbers, except that they are primed. The insert 42 has a generally tapered body 12', a central longitudinal axis 14' and a base portion 18', and a plurality of grooves 20'. The insert 42 further has a generally cylindrical post 43 disposed rearwardly of the rearward surface 21' of the base 18' which is axially aligned with the longitudinal axis 14' thereof. The post 43 is adapted to fit within a cylindrical hole in the center of a socket 35 to provide further support for the attachment of the insert 42 therein. Like the insert 10, the insert 42 has a plurality of grooves 20' and when the insert 42 is attached to a tool 25 and put into service, cuttings broken by the forward end 16' of the insert 10' will wear a groove 41 in the tool 25 as depicted in FIG. 6.

Figure 9:
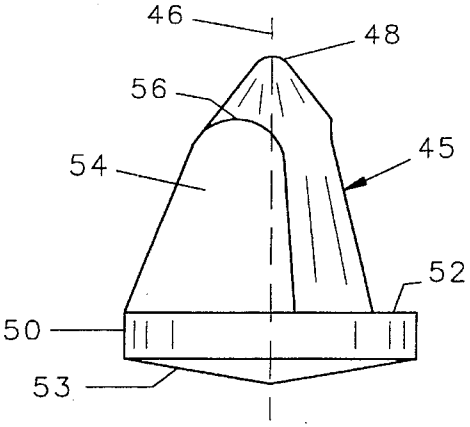
FIG. 9 is a side view of the insert shown in FIG. 8.
Figure 8:
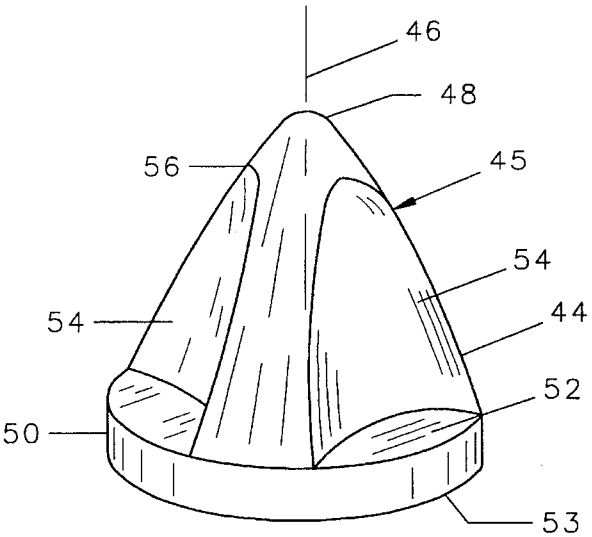
FIG. 8 is an isometric view of another insert embodying the present invention.

Referring next to FIGS. 8 and 9 which depict yet another embodiment of an insert in accordance with the present invention. In this embodiment, the insert 45 has a generally tapered central body 44, and a longitudinal axis 46, and a forward cutting end 48. The rearward end of the insert 45 has a generally cylindrical base 50 having a substantially planar forward surface 52 and a conical rearward surface 53. The insert 45 further has a plurality of grooves 54 and the inner surfaces of each groove 54 extend from the forward surface 52 of the base 50, forwardly nearly parallel to the longitudinal axis 46 of the insert 45 and ending at a position 56 near the cutting end 48. Like the inserts shown in FIGS. 1, 2, 3 and 7, the surfaces of the grooves 54 are nearly parallel to the longitudinal axis 46 of the insert 45, and in the preferred embodiment also have a draft angle of about 7 degrees.

Figure 10:
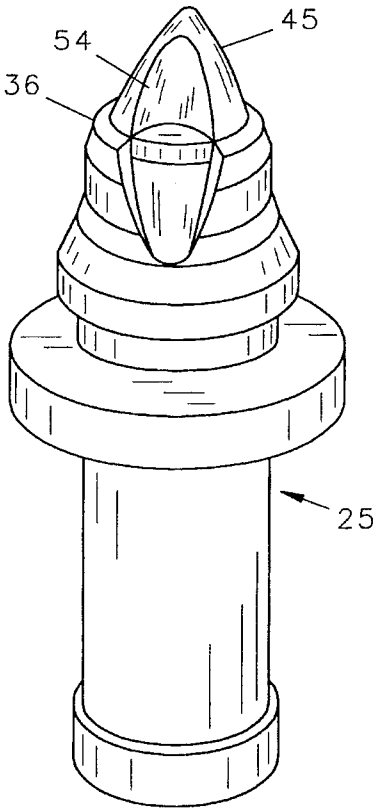
FIG. 10 is an isometric view of the insert shown in FIG. 8 fitted to a tool such as shown in FIGS. 4 and 5 after which the tool has been subjected to wear.

Referring to FIG. 10, when the insert 45 is fitted into a socket 35 at the forward end of a tool 25 and placed in service for a period of time, portions of the tubular forward end 36 of the tool 25 will again be worn away rearward of each of the grooves 54 forming an extension 49 of the groove 54. The remaining portions of the tubular forward end 36 will continue to retain the insert 45 to the tool 25.

Figure 12:
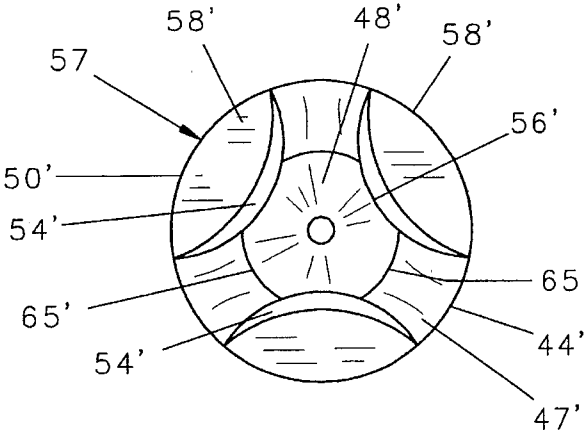
FIG. 12 is a top view of the insert shown in FIG. 11.

Another insert 57 is depicted in FIGS. 11 and 12 and portions of insert 57 which are like portions of insert 45 bear like indicia numbers except that they are primed. The insert 57 has a tapered central body 44', a forward cutting end 48' and a cylindrical base 50' with a conical rear surface 53'. Along the length of the central body 44' are a plurality of grooves 54' which extend forwardly from the forward surface 58 of the base 50'. Unlike the forward surface 52 of the base of insert 45, the forward surface 58 of base 50' is not planar, nor is it perpendicular to the longitudinal axis 46' of the insert. In this embodiment, the forward surface 58 slopes forwardly from the edges toward the center at an angle 59 of approximately 30 degrees, such that the exposed portions of surface 58 define a conical or frustoconical surface. The forwardly sloping surface 5 reduces the accumulation of particles in the pockets formed by the intersection of the grooves 54' with the forward surface 58 of the base 50' and, therefore, it assists in directing cut particles away from the cutting end 48' of the insert 57. Additionally, the sloping surface 58 provides structural support to the column of the central body 44'.

The outer surfaces 47 of the central body 44' define segments of a frustoconical surface having sides which slope forwardly inward at an angle 51 which in the preferred embodiment is about 23 degrees. As described with respect to the first insert 10, the outer portions of the central body 44' could also be described as buttresses which reinforce the column of the central body 44' of the insert 57.

The forward cutting end 48' is also generally conical with a relatively large apex angle 55 of about 95 degrees. The forwardmost tip of the cutting end 48' is semispherical and has a radius 61 of about ⅛ inch, a structure which has been found can sustain tremendous impact without fracturing. Like the insert shown in FIGS. 8 and 9, the insert 57 has three grooves 54', such that the portions of the body 44' between the grooves 54' form buttresses. As can be seen in the drawings, the large apex angle 55 of the cutting end 48' gives a blunt appearance which is accentuated by the fact that the diameter of the cutting end 48' is approximately half the outer diameter of the base 50'. The grooves 54' also extend into the cutting end 48' such that the outer rim 65 of the cutting end 48' forms a knee at the forward end of the buttresses. The buttress configuration will, therefore, provide support to the central body 44' along its length and to the cutting end 48'.

Figure 13:
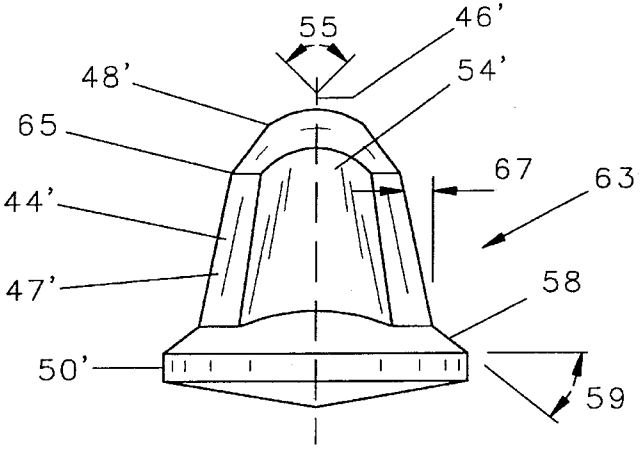
FIG. 13 is a side view of an insert bearing similarities to the insert 12 shown in FIG. 11.
Figure 14:
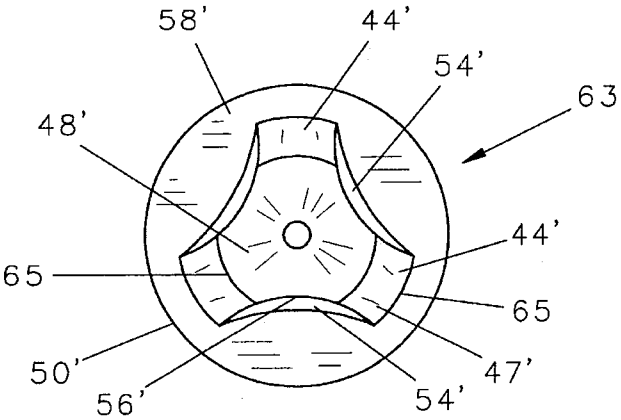
FIG. 14 is a top view of the insert shown in FIG. 13.

Another insert 63 depicted in FIGS. 13 and 14 is a modification of the insert 57, and the indicia numbers for the portions of insert 63 which are like the portions of insert 57 bear like indicia numbers. Insert 63 has a forward cutting end 48', a frustoconical central body 44' with a plurality of longitudinal grooves 54' therein and a cylindrical base 50'. The base 50' of the insert 63 also has a forward surface 58 which slopes forwardly at an angle 59 of approximately 30 degrees, and the forward cutting end 48' has an apex angle 55 of about 95 degrees, all as described with respect to insert 57. Unlike the insert 57, however, the outer surface 47' of the central body 44' has sides which slope forwardly inward at an angle 67 which in the preferred embodiment is only about 3 to 7 degrees, and as can be seen in the drawings, the maximum outer diameter at the base of the central body 44' is significantly smaller than the outer diameter of the cylindrical base 50'. This structure provides for support from the buttresses to the forward cutting end 48' and also a narrower cutting tip which is particularly useful for cutting and removing softer materials. It should also be appreciated that an insert in accordance with this embodiment would be made without using as much tungsten carbide without causing a significant reduction of strength to the forward cutting end 48'. The reduction of the material used enables one to manufacture the insert at less expense.

Figure 16:
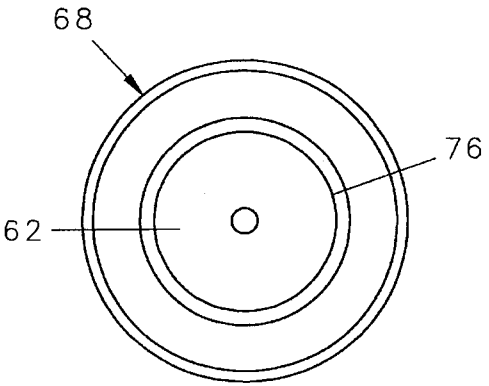
FIG. 16 is a top view of the insert shown in FIG. 15.
Figure 15:
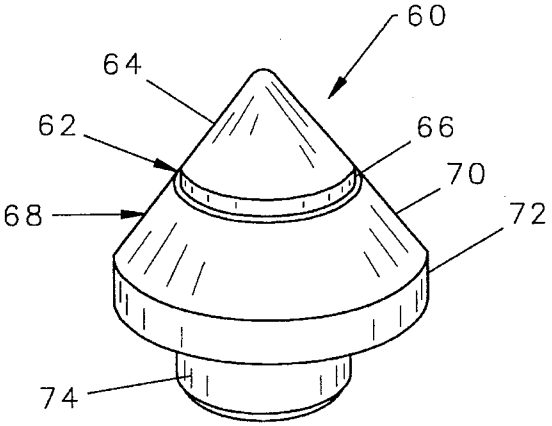
FIG. 15 is an isometric view of another insert embodying the present invention.

Referring to FIGS. 15 and 16, another embodiment of an insert 60 is depicted. In this embodiment, the insert 60 has an elongate central body 62 having a conical forward cutting end 64 and a cylindrical midsection 66. Disposed around a portion of the cylindrical midsection 66 is an annular collar 68 also made of tungsten carbide. The annular collar has a frustoconical forward portion 70 and a generally cylindrical base portion 72 suitable for insertion into a socket. As can be seen in FIG. 15, a portion of the cylindrical midsection 66 extends rearward of the rearward end of the cylindrical base 72 so as to form a post 74. Like the post 43 of the insert shown in FIG. 7, the post 74 is adapted to fit within a hole in the center of a socket to further retain the insert 60 to the socket.

Referring to FIG. 16, the annular collar 68 is bonded to the cylindrical midsection of the body 62 by a suitable bonding material such as a braising material 76. The braising material 76 has a hardness which is substantially less than the hardness of the tungsten carbide of the central body 62 and the annular collar 68. Typically, the braising material 76 is made of an alloy of metals including nickel, zinc, copper and manganese. This metal is more elastic than tungsten carbide, and can be deformed when subjected to stress and, therefore, provide a shock absorbing quality between the central body 62 and the collar 68. The shock absorbing qualities of the braising material 76 dissipates shock from the forward end 64 of the insert 60 down the length of the insert 60 to the socket of the tool 25, and as a result thereof a greater portion of the shock is absorbed by the tool. It has been found that the provision of a braising material positioned between the inner portion 62 and the outer portion 68 of the insert 60 causes the insert 60 to be more resistive to shock, and to have a reduced incidence of breakage from use thereof and a corresponding longer useful life.

Figure 17:
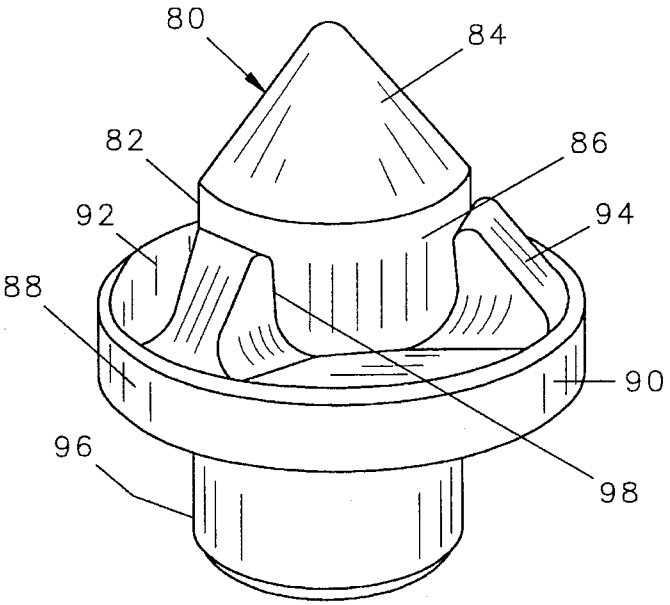
FIG. 17 is an isometric view of yet another insert embodying the present invention.

Referring to FIG. 17, in which another embodiment of the present invention is depicted, an insert 80 has an elongate central body 82 of tungsten carbide with a forward cutting end 84 and a cylindrical midsection 86. Disposed around a portion of the cylindrical midsection 86 is an annular collar 88 also formed of tungsten carbide. The annular collar 88 has a generally cylindrical base portion 90 with a generally planar forward surface 92. Extending from the forward surface 92 to a portion of the midsection 86 are a plurality of buttresses 94 similar to those described in my prior application Ser. No. 114,832. Also, a portion of the central body 82 extends rearwardly of the rearward surface of the base 90 so as to form a post 96 for insertion into a hole in a socket as previously described.

Between the central body 82 and the annular collar 88 is an adhesive material 98 such as braising material provided to bond the annular collar 88 to the central body 82. As has been described with respect to FIGS. 15 and 16, the braising material 98 absorbs shock within the insert, thereby reducing the incidence of breakage of the insert as a result of shock when the insert is applied against very hard surfaces.

It should be apparent that the shock absorbing qualities of the braising materials 76, 98 will be beneficial in inserts having a tungsten carbide central body 62, 82 with the same hardness and grain size as the tungsten carbide of the associated annular collar 68, 88. It should be further appreciated that the spaces between buttresses 94 of the insert shown in FIG. 14 provide channels such that particles of material cut by the forward end 84 of the insert 80 will be directed between the buttresses 94 and will wear the supporting tool as shown in FIG. 10 with respect to insert 45. The spaces between adjacent buttresses 94 will, therefore, provide the same beneficial functions served by the grooves 20, 54 described with respect to the insert shown in FIGS. 1, 2, 3, 7, and 8.

While the present invention has been described in connection with a plurality of embodiments thereof, it will be understood that many changes and modifications may be made without departing from the true spirit and scope of the present invention, and it is intended by the appended claims to cover all such changes and modifications which come within the true spirit and scope of the present invention.

What is claimed:

1. An insert for a cutting tool comprising in combination:

a tapered central body with a principal longitudinal axis, a forward cutting end and a rearward end, a base disposed rearwardly of said rearward end of said tapered central body, said base having a planar forwardly facing surface, said central body having a plurality of longitudinal grooves therein, each of said grooves extending forwardly from said planar forwardly facing surface to a location near said cutting end.

2. An insert in accordance with claim 1 wherein said base has a conical reardwardly facing surface.

3. An insert in accordances with claim 2 wherein said conical rearwardly facing surface has an apex angle of about 160 degrees.

4. An insert for a cutting tool comprising in combination:

a forward cutting end having an outer rim, a tapered central body with a principal longitudinal axis, and a rearward end, said tapered central body disposed rearwardly of said forward cutting end, a base disposed rearwardly of said reardward end of said tapered central body, said base having portions of a conical forwardly facing surface, said central body having a plurality of longitudinal grooves therein said grooves extending into said outer rim of said forward cutting end, and each of said grooves extending forwardly from said conical forwardly facing surface to a location in said cutting end.

5. An insert in accordance with claim 4 wherein said forward cutting end has an apex angle of about 95 degrees and said outer rim has a diameter equal to about one half of a diameter of said base.

6. An insert in accordance with claim 5 wherein said tapered central body is frustoconical with sides which slope inward at an angle of about 23 degrees.

7. An insert in accordance with claim 4 wherein the most forward portion of said forward cutting end is semispherical with a radius of about ⅛ inch.

8. An insert in accordance with claim 4 wherein said rearward end of said tapered central body has a largest outer diameter which is less than a largest outer diameter of said base.

9. An insert in accordance with claim 8 wherein said tapered central body is frustoconical with sides which slope inward at an angle of between 3 to 7 degrees.

10. An insert in accordance with claim 4 wherein said base has a conical rearwardly facing surface.

11. An insert according to claim 4 wherein said forward cutting end has a semispherical forwardmost tip and a frustoconical portion.

12. An insert for a cutting tool comprising in combination:

a rounded front end section having a rear end, a frustoconical intermediate section disposed rearwardly of said front end section, said frustoconical intermediate section having an angle of incline and having a small diameter forward end and a large diameter rear end, said rounded front end section blending at said rearward end thereof with said small diameter end of said frustoconical intermediate section, a tapered central body section disposed rearwardly of said intermediate section and juxtaposed with said large diameter end of said frustoconical intermediate section, said tapered central body having an angle of incline substantially different from said angle of incline of said frustoconical intermediate section, said central body section having a rearward end, a base disposed rearwardly of said rearward end of said central body section and being juxtaposed therewith, said base having a plurality of spaced apart portions of a forwardly facing frustoconical surface, and said central body section having a plurality of longitudinal grooves extending forwardly from respective ones of said spaced apart portions of said base to locations rearwardly of said rounded front end section and forwardly of said large diameter rear end of said intermediate section, said grooves defining a plurality of longitudinal buttress portions of said central body section extending from said base and into said intermediate section.

* * * * *

UNITED STATES PATENT AND TRADEMARK OFFICE

CERTIFICATE OF CORRECTION

PATENT NO. : 5,551,760

DATED : September 3, 1996

INVENTOR(S) : Phillip A. Sollami

It is certified that error appears in the above-identified patent and that said Letters Patent is hereby corrected as shown below:

In column 2, line 65, after "the" second occurrence, delete "gutting" and substitute --cutting--.

In column 4 line 2, after "there" delete "re" and substitute --are--.

In column 5, line 42, after "FIGS." delete "11" and substitute --1--.

In column 8, line 48, after "said" delete "reardward" and substitute --rearward--.

Signed and Sealed this

Twenty-fourth Day of December, 1996

Bruce Lehman

*Attest:*

BRUCE LEHMAN

*Attesting Officer*

*Commissioner of Patents and Trademarks*